US008061000B2

(12) United States Patent
Santamarina et al.

(10) Patent No.: US 8,061,000 B2
(45) **Date of Patent: *Nov. 22, 2011**

(54) ANCHOR INSTALLATION TOOL

(75) Inventors: Aland Santamarina, Columbia, MD (US); Scott Muhlbaier, Baltimore, MD (US)

(73) Assignee: Black & Decker Inc., Newark, DE (US)

( * ) Notice: Subject to any disclaimer, the term of this patent is extended or adjusted under 35 U.S.C. 154(b) by 826 days.

This patent is subject to a terminal disclaimer.

(21) Appl. No.: 12/134,439

(22) Filed: Jun. 6, 2008

(65) Prior Publication Data

US 2009/0302088 A1 Dec. 10, 2009

(51) Int. Cl.
*B25B 27/14* (2006.01)
*B25C 7/00* (2006.01)

(52) U.S. Cl. ..... 29/275; 29/254; 29/271; 29/278; 227/147; 227/139; 173/128; 173/29; 81/463

(58) Field of Classification Search ..... 29/275, 29/278, 254, 271, 272, 244; 227/147, 139, 227/142, 156; 173/29, 128; 81/436, 177.85, 81/463; 7/143, 165, 158
See application file for complete search history.

(56) References Cited

U.S. PATENT DOCUMENTS

| | | | | |
|---|---|---|---|---|
| 1,697,414 | A | | 1/1929 | Cordray |
| 1,765,729 | A | | 6/1930 | Morte |
| 1,925,385 | A | | 9/1933 | Humes et al. |
| 2,093,261 | A | | 9/1937 | Willson |
| 2,114,451 | A | | 4/1938 | Mattes |
| 2,445,674 | A | | 7/1948 | Kendall |
| 2,543,942 | A | | 3/1951 | Shaff |
| 2,575,079 | A | | 11/1951 | Temple |
| 2,638,591 | A | | 5/1953 | Harris |
| 2,641,379 | A | | 6/1953 | Barbaro |
| 3,163,865 | A | | 1/1965 | Zetzer et al. |
| 3,370,655 | A | | 2/1968 | Chromy |
| 3,503,549 | A | | 3/1970 | Brunelle |
| 3,602,419 | A | | 8/1971 | Doberne et al. |
| 3,618,445 | A | | 11/1971 | Hartmann et al. |
| 3,847,193 | A | | 11/1974 | Brunstetter |
| 3,965,510 | A | | 6/1976 | Ernst |
| 4,007,795 | A | | 2/1977 | Gawron et al. |
| 4,092,753 | A | * | 6/1978 | Fuhrmann ..... 7/158 |
| 4,107,800 | A | | 8/1978 | Jorgensen |
| 4,127,000 | A | | 11/1978 | Montgomery, Jr. et al. |
| 4,201,072 | A | | 5/1980 | Snell |
| 4,218,795 | A | | 8/1980 | Ernst et al. |

(Continued)

FOREIGN PATENT DOCUMENTS

| | | |
|---|---|---|
| DE | 27 00 877 | 8/1977 |

(Continued)

*Primary Examiner* — Essama Omgba
(74) *Attorney, Agent, or Firm* — Scott B. Markow

(57) ABSTRACT

An anchor installation tool has an elongated member with a body portion and a head portion. The body portion includes an internal bore to receive a drill bit. The head portion projects from and has a diameter smaller than the body portion. The head portion is coaxial with the body portion. An anchor guide has a sleeve-shaped body with a bore throughout the body. The bore has a portion sized to fit over the body portion and a portion to fit over the head portion. The guide slides on the body and head portions. A mechanism retains the anchor guide onto the body portion. The retaining mechanism enables sliding of the anchor guide and prohibits removal of the anchor guide from the body portion.

14 Claims, 3 Drawing Sheets

U.S. PATENT DOCUMENTS 4,289,010 A 9/1981 Badger
4,367,778 A 1/1983 Bradbury
4,422,489 A 12/1983 Ross
4,448,339 A 5/1984 Pettigrew
4,468,826 A 9/1984 Moores, Jr.
4,512,693 A 4/1985 Swanson
4,637,539 A 1/1987 Turcott et al.
4,676,703 A 6/1987 Swanson
4,867,249 A 9/1989 Watkins, Jr. et al.
4,890,779 A 1/1990 Giannuzzi
4,899,431 A 2/1990 Borntrager
4,954,025 A 9/1990 Crawford et al.
5,011,354 A 4/1991 Brownlee
5,030,043 A 7/1991 Fischer et al.
5,038,435 A 8/1991 Crawford et al.
5,050,286 A * 9/1991 Miyanaga ..... 29/275
5,142,954 A 9/1992 Starke
5,165,588 A 11/1992 Rowland
5,184,385 A 2/1993 Valesh
5,313,680 A * 5/1994 Ringler ..... 7/138
5,524,808 A * 6/1996 Vogrig ..... 227/147
5,586,847 A * 12/1996 Mattern et al. ..... 408/239 A
5,588,788 A 12/1996 Dominguez
5,711,043 A 1/1998 Crawford et al.
5,913,792 A 6/1999 Fischer
5,979,913 A 11/1999 Kosik et al.
6,062,789 A 5/2000 Pope
6,220,122 B1 4/2001 Forsell
6,223,375 B1 5/2001 Vaughan, Jr.
6,457,926 B1 10/2002 Pope
6,585,143 B1 7/2003 Schultz
6,668,941 B2 12/2003 Phillips et al.
6,848,346 B1 2/2005 Panasik
6,877,937 B2 4/2005 Hsiao
6,915,936 B2 7/2005 Estes
6,928,778 B2 8/2005 Schmid
6,935,821 B2 8/2005 Bodin et al.
7,065,855 B2 6/2006 Janusz
7,121,357 B1 10/2006 Raimondi
7,127,972 B2 10/2006 Klein et al.
7,237,987 B2 7/2007 Hernandez, Jr. et al.
7,354,230 B2 4/2008 Baumann
7,374,377 B2 5/2008 Baumann
7,404,563 B2 7/2008 Hernandez, Jr. et al.
7,407,073 B2 8/2008 Rafaeli
7,814,631 B2 * 10/2010 Wallek ..... 29/254
2001/0029634 A1 10/2001 Lamarre
2002/0124371 A1 9/2002 Livingston
2004/0105734 A1 6/2004 Yekutiely et al.
2004/0134312 A1 7/2004 Hodges
2005/0051596 A1 3/2005 Estes
2005/0163585 A1 7/2005 Bodin et al.
2005/0178244 A1 8/2005 Hodges
2006/0048611 A1 3/2006 Berdin et al.
2006/0213014 A1 9/2006 Manske
2008/0023924 A1 1/2008 Chiang
2008/0173141 A1 7/2008 Wallek
2011/0089218 A1 * 4/2011 Santamarina et al. ..... 227/139

FOREIGN PATENT DOCUMENTS

DE 8903996 U 8/1990
DE 39 14 512 11/1990
DE 91 10 513.7 2/1993
DE 295 07 697 8/1995
DE 199 04 849 8/2000
DE 100 00 059 10/2001
DE 202 18 422 5/2004
EP 392 201 3/1990
EP 399 164 3/1990
EP 955 130 4/1999
EP 1 281 481 6/2002

* cited by examiner

ANCHOR INSTALLATION TOOL

FIELD

The present disclosure relates to masonry construction and, more particularly, to a tool to install anchors in masonry concrete or the like.

BACKGROUND

In the past, various types of anchor installation tools have been used. Ordinarily, a drill is used to form a hole in the concrete or masonry structure. The anchor is inserted into the bore. After that, a hammer is utilized to pound the anchor into the masonry material. While this application is satisfactory, it is time consuming and very demanding on the user. In fact, when anchors are to be inserted overhead, the user must pound upwardly with a hammer in order to sink the anchor into the structure. This is very demanding on the body of the user.

Other types of percussion tools are in the art. These tools enable a drill to be positioned into a hammer bit for drilling a bore into the concrete material. A beat piece is positioned on top of the drill in order to utilize the hammer drill to secure the anchor into the concrete or masonry material. While these tools function satisfactory for their intended purpose, designers strive to improve the art.

Accordingly, the present disclosure provides an anchor installation tool that eliminates the use of manual hammering. The present disclosure provides an anchor tool that is usable in tight spaces where the wielding of a hammer is difficult and time consuming. The present disclosure provides a simple yet effective tool to insert anchors into the concrete material. Additionally, the installation tool provides a guide to ensure proper alignment of the anchor in the bore.

SUMMARY

In accordance with the disclosure, an anchor installation tool comprises an elongated member with a body portion and a head portion. The body portion includes an internal bore to receive a drill bit. The head portion projects from and has a diameter smaller than the body portion. The head portion is coaxial with the body portion. An anchor guide is slidably secured on the elongated member. The anchor guide has a sleeve shaped body and a bore through the sleeve. The bore has a first portion size to fit over the body portion as well as a second portion size to fit over the head portion. The magnet is retained in the bore to enhance the retention of the anchor in the bore. Thus, the guide slides on the body and head portions. A mechanism retains the anchor guide on the body portion. The retaining mechanism enables the sliding movement of the anchor guide and prohibits removal of the anchor guide from the body portion. The retaining mechanism includes a groove in the body portion with a retaining member in the groove. A stop surface is on the anchor guide. The retaining member may be a retaining clip or an O-ring. The anchor guide includes a receiving portion to receive an anchor. The receiving portion is adjacent to the end of the second bore portion.

In accordance with a second aspect of the disclosure, an anchor installation tool comprises a drill bit and an elongated member with a body portion and a head portion. The body portion includes an internal bore to receive a drill bit. The head portion projects from and has a diameter smaller than the body portion. The head portion is coaxial with the body portion. An anchor guide is slidably secured on the elongated member. The anchor guide has a sleeve shaped body and a bore through the sleeve. The bore has a first portion size to fit over the body portion as well as a second portion size to fit over the head portion. The magnet is retained in the bore to enhance the retention of the anchor in the bore. Thus, the guide slides on the body and head portions. A mechanism retains the anchor guide on the body portion. The retaining mechanism enables the sliding movement of the anchor guide and prohibits removal of the anchor guide from the body portion. The retaining mechanism includes a groove in the body portion with a retaining member in the groove. A stop surface is on the anchor guide. The retaining member may be a retaining clip or an O-ring. The anchor guide includes a receiving portion to receive an anchor. The receiving portion is adjacent to the end of the second bore portion.

According to a further aspect, a method for setting an anchor comprises drilling a hole in a structure with a drill bit. The anchor is positioned into the tool. The tool has an elongated member with a body portion and a head portion. The body portion including an internal bore to receive the drill bit. The head portion projects from and has a diameter smaller than the body portion. The head portion is coaxial with said body portion. An anchor guide with a sleeve shaped body and through bore is fit over the body and the head portions. The anchor is positioned in the anchor guide bore. A percussive movement is provided on the drill bit. The percussive movement drives the anchor into the structure. The percussive movement is provided by a hammer drill.

From the following detailed description taken in conjunction with the accompanying drawings and claims, other objects and advantages will become apparent from the disclosure.

DRAWINGS

The drawings described herein are for illustration purposes only and are not intended to limit the scope of the present disclosure in any way.

Figure 5A:
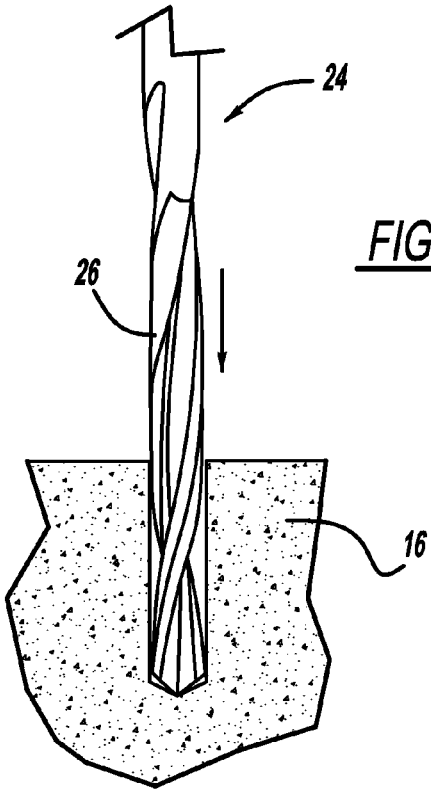
Figure 5B:
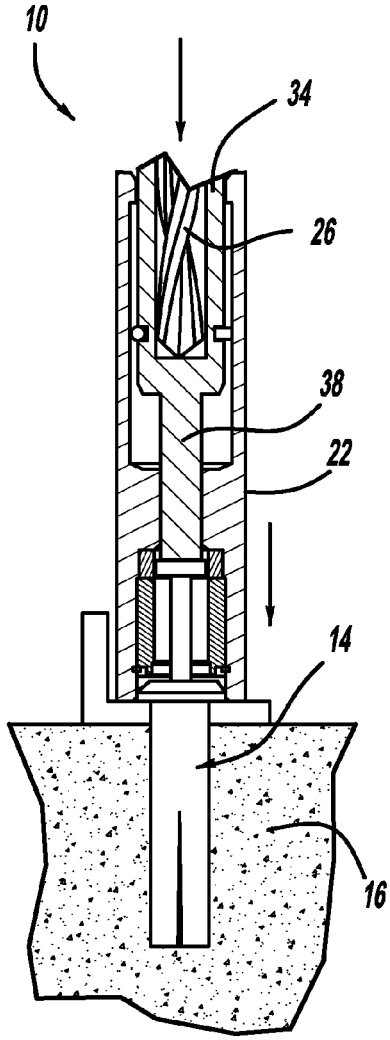
Figure 5C:
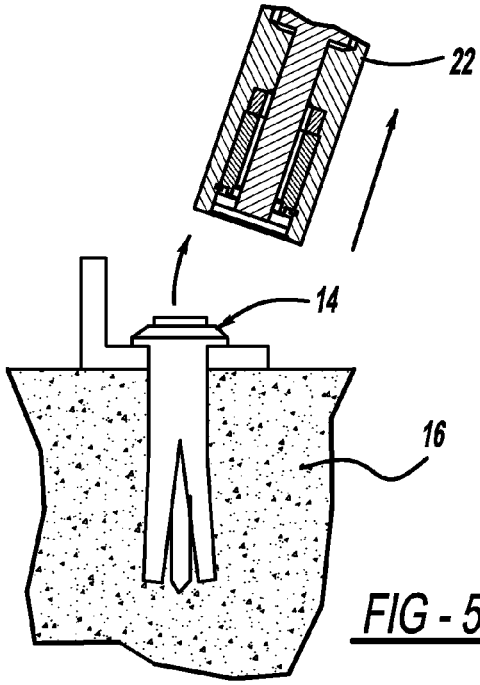

FIG. 5*a-c* is a schematic illustration of positioning an anchor into a concrete structure.

DETAILED DESCRIPTION

The following description is merely exemplary in nature and is not intended to limit the present disclosure, application, or uses.

Turning to the figures, an installation tool in accordance with the disclosure is illustrated and designated with the reference numeral 10. A hammer drill 12 is illustrated receiving the anchor installation tool 10. A nail-in anchor 14 is illustrated being secured into a structure 16.

Figure 2:
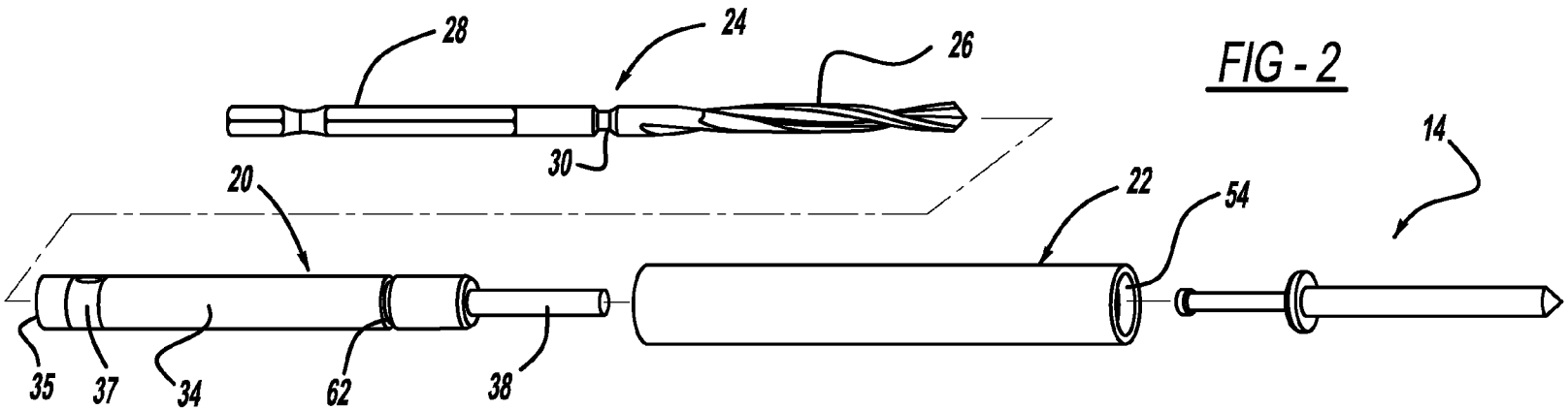
FIG. 2 is an exploded view of the anchor tool of FIG. 1.

Moving to FIG. 2, the anchor installation tool 10 is illustrated. The installation tool 10 includes an elongated member 20 and an anchor guide 22. Additionally, the installation tool 10 can be combined with a drill bit 24. The drill bit 24 includes a fluted portion 26 as well as a chucking portion 28. A groove 30 is formed in the drill bit to assist in retaining the installation tool 10 on the drill bit 24. Chucking portion 28 may include a hexagonal shank with a groove to position the drill bit 24 into the hammer drill 12.

The elongated body 20 includes an internal bore 32 extending through a body portion 34 of the elongated member 20. The body portion 34 generally has a desired diameter and a desired wall thickness with an open end 35 and a closed 36 end. The closed end 36 of the body member 34 includes a projecting head 38. The head 38 projects substantially coaxial with the body member 34. The head 38 has a desired length and diameter. Ordinarily, the head 38 is a solid portion. A drill bit retainer 37 is positioned near the open end 35. The drill bit retainer 37 includes a ball 39, and a spring clip 41. The ball 39 is seated in a bore 43 in the body portion 34. A portion of the ball 39 projects through the bore 43 into bore 32. The ball 39 couples with the drill bit groove 30 to retain the installation tool 10 on the drill bit 24.

The elongated member 20 is generally made out of a metallic material such as steel. The junction where the head 38 projects from the closed end 36 forms a stop surface 40 at the end of the body portion 34. The stop surface 40 contacts a stop surface of the anchor guide 22 as will be explained later.

The anchor guide 22 has a sleeve-shaped body 42. The sleeve 42 includes an internal bore 44 which extends through the sleeve shaped body 42. The bore 44 includes a first portion 46, a reduced diameter portion 47, a second portion 48 and end portion 50. The first portion 46 is sized to fit over the body portion 34 of the elongated member 20. The reduced diameter portion 47 is sized to fit over the head portion 38. A stop 52 is formed at the transition between the two bore portions 46, 47. The stop 52 provides a surface that abuts against the surface 40 to stop further movement of the guide anchor 22 as it slides along the head 38 and body portions 34.

Figure 4:
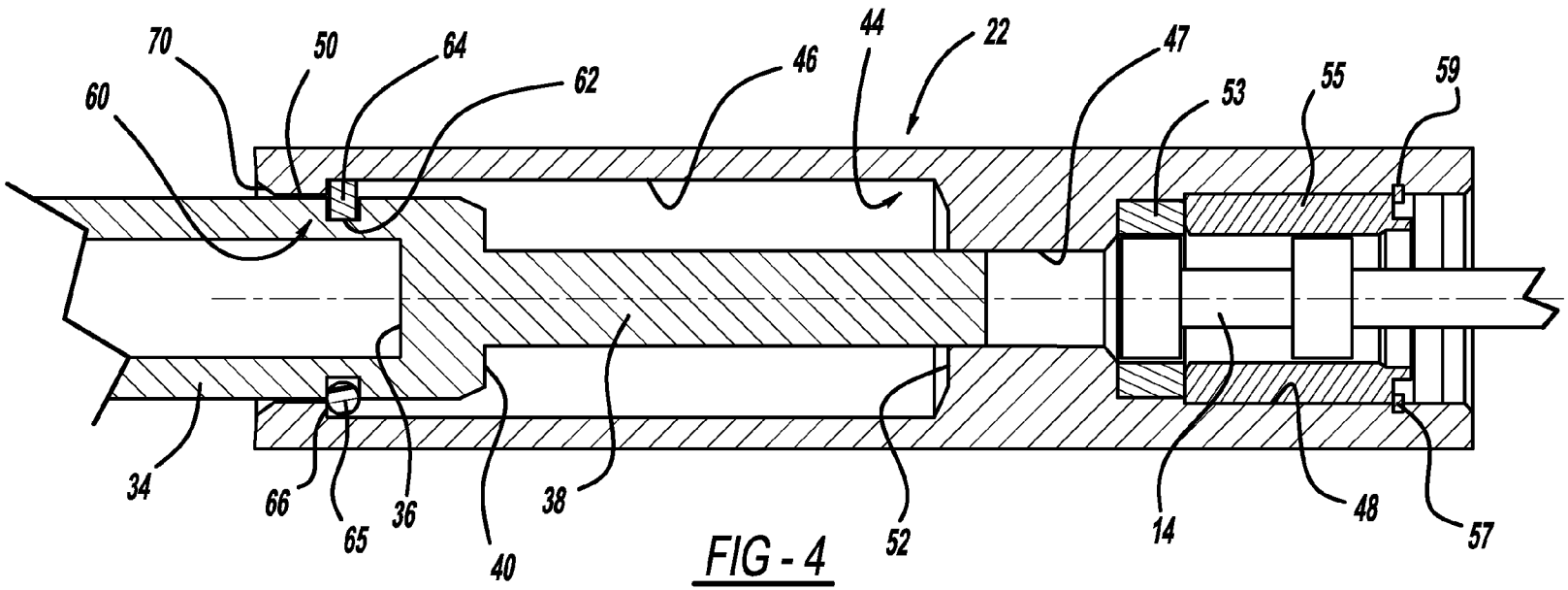
FIG. 4 is an enlarged cross-section view of FIG. 3.

The second bore portion 48 is on the other side of the reduced diameter portion 47. The second portion 48 received an annular magnet 53 and spacer 55. The magnet assists in retaining the anchor in the tool 10. The magnet 53 is the sole retention member when a duply or double head nail is used as the anchor as shown in FIG. 4. The spacer 55 positions the magnets 53 adjacent the reduced diameter portion 47. A C-clip 57 positioned in groove 59 holds the spacer 55 and magnet in the second bore portion 48.

An anchor receiving member 54 is at the end of the second bore portion 48 beyond groove 59. The receiving member 54 is an enlarged bore that receives the head of the anchor 14. With the nail portion of the anchor extending into the bore 48 adjacent the magnet 53, and its head captured in the receiving member 54 the anchor 14 is held in the anchor guide 22 so that it may be inserted into a bore in a concrete structure as seen in FIG. 5A.

Turning to FIG. 4, an enlarged cross-sectional view of the retention mechanism is illustrated. The retention mechanism 60 includes a groove 62 a retaining clip 64 and a stop surface 66 on the anchor guide 22. The groove 62 is formed into the outer surface of the body member 34. The groove 62 is circumferentially spaced about the body member 34. A retention clip 64, generally a C-clip, is positioned onto the body member 34. The retention clip 64 extends radially outwardly above the body member 34 from the groove 62 as seen in FIG. 4. Thus, the retaining clip 64 acts as a stop when the guide member 22 is slid forward on the head 38 and the body member 34 to prevent complete removal of the elongated member 20 from the anchor guide 22. The stop surface 66 is formed at the junction of the first bore portion 46 and the end portion 50. The end portion 50 has a diameter slightly smaller than the first bore portion 46.

A chamfer 70 is formed at the end of the guide member 22. The chamfer 70 enables the guide member 22 to slide over top of the C-clip 64, compressing it radially inward to move over the C-clip 64 to retain the guide 22 on the body portion 34. Thus, after an anchor is set into the concrete structure, the guide 22 is pulled forward, toward head 38, on the body portion 34 until the stop surface 66 contacts the retention clip 64. In an alternative embodiment, an O-ring 65 is utilized as illustrated on the bottom half of FIG. 4. The O-ring 65 acts in the same manner to retain the guide member 22 on the body portion 34.

Figure 1:
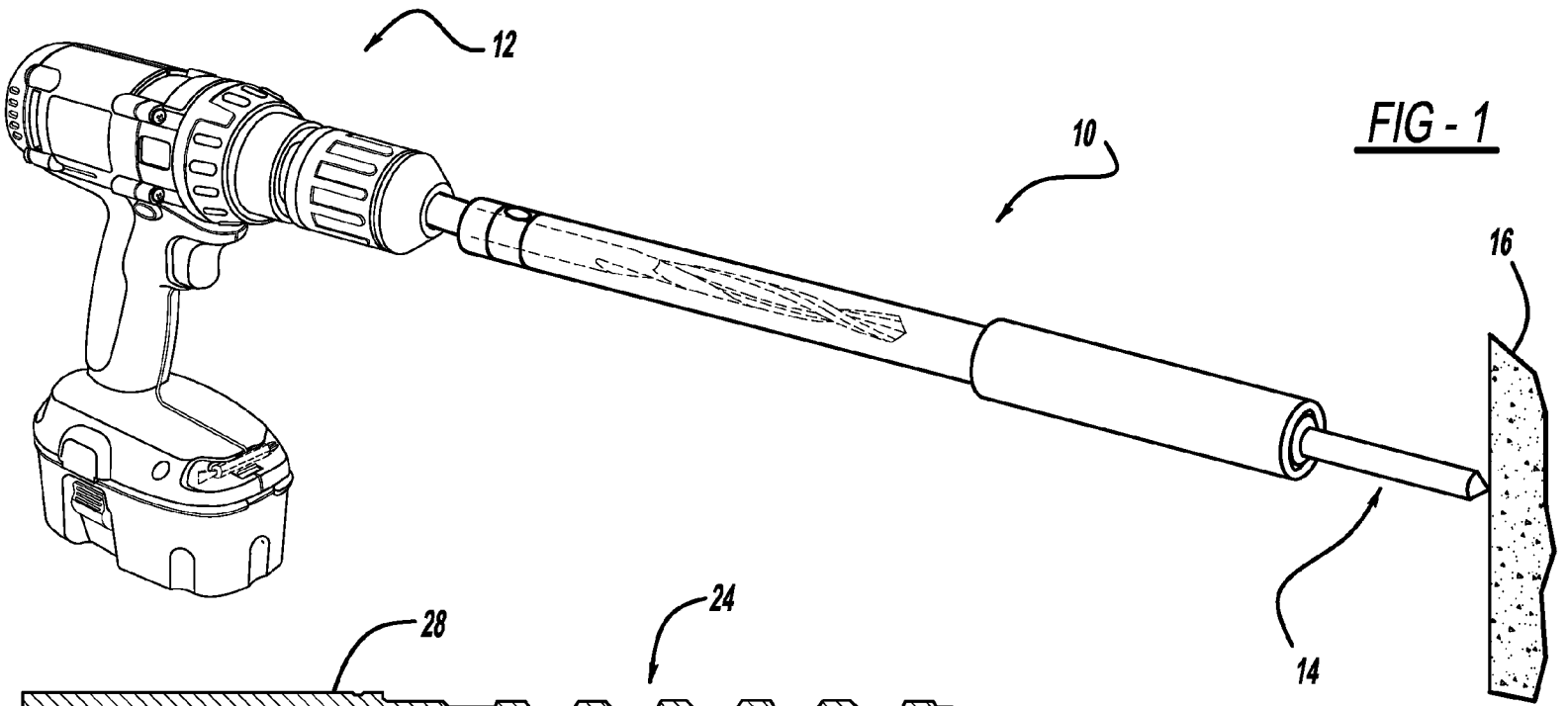
FIG. 1 is a perspective view of a hammer drill and installation tool driving an anchor into a structure.
Figure 3:
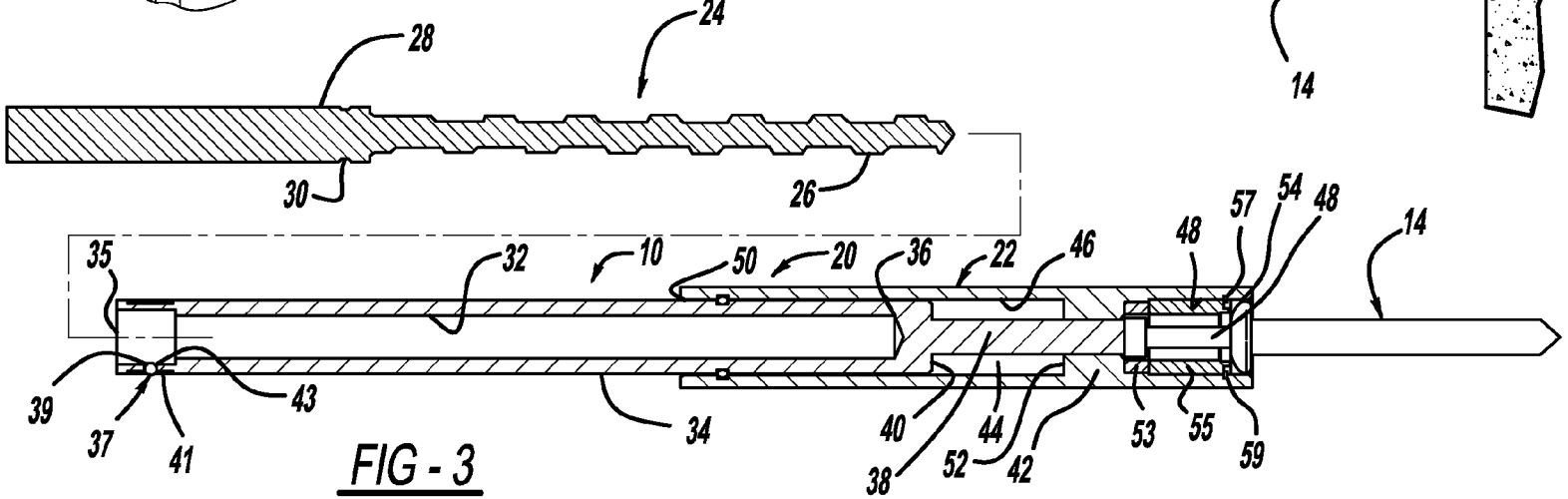
FIG. 3 is a cross-section view of FIG. 2 along line 3-3 thereof.

A method of using the anchor installation tool is as follows. The anchor installation tool is removed from the drill bit on the hammer drill 12. A hole or bore is drilled into the concrete structure 16 to a desired depth as illustrated in FIG. 5A. The elongated body member 34 of the tool 10 is then positioned over the drill bit as illustrated in FIG. 3. Additionally, the guide member 22 is extended so that the stop surface 66 engages the retention clip 64. A nail-in type anchor 14 is positioned with a nail portion in the second bore portion 48 adjacent magnet 55 and a head of the insert in the receiving portion 52 of the guide 22 as seen in FIG. 5B. The anchor 14 is inserted into the concrete hole or bore as illustrated in FIG. 5B. At that time, the hammer drill 12 is activated to percussively pound the nail-in anchor into the structure. As this occurs, the nail is pounded into the concrete to spread the insert as illustrated in FIG. 5C. After the nail has been set, the anchor installation tool 10 is removed from the nail and the drive guide 22 is positioned back over the head 38 of the elongated member 20 ready for its next use.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An anchor installation tool comprising:

an elongated driving member defining an axis and having a rear body portion and a front head portion extending frontward from the body portion and having an outer diameter that is smaller than an outer diameter of the body portion, the body portion defining an internal bore configured to receive a drill bit, the body portion further including a retaining member configured to engage with the drill bit to inhibit removal of the drill bit from the body portion;

an anchor guide having a sleeve body defining a bore having a rear portion sized to slidably receive the body portion of the driving member and a front portion sized to slidably receive the head portion of the driving member, the front portion further including a holding member configured to releasably hold an anchor in the front portion of the bore; and a stopping member coupled to at least one of the driving member and the anchor guide to prevent complete removal of the driving member from the anchor guide, wherein when an anchor is held in the anchor guide and a drill bit is inserted into the driving member, axial movement of the drill bit is transferred to axial movement of the driving member, which causes the head portion to strike the anchor and eject the anchor from the anchor guide.

2. The anchor installation tool of claim 1, wherein the retaining member includes a biased body that engages a corresponding groove in the drill bit.

3. The anchor installation tool of claim 2, wherein the biased body includes a ball and a spring clip biasing the ball generally transverse to the axis.

4. The anchor installation tool of claim 1, wherein the holding member includes a magnet.

5. The anchor installation tool of claim 1, wherein the stopping member defines an interior shoulder in the anchor guide bore that engages with a portion of wider diameter on the driving member.

6. The anchor installation tool of claim 1, wherein the stopping member includes a groove in the driving member, a ring received in the groove, and a stop surface on the anchor guide bore.

7. The anchor installation tool of claim 6, wherein the ring includes at least one of a spring clip and an O-ring.

8. An anchor installation kit comprising:

a drill bit;

an elongated driving member defining an axis and having a rear body portion and a front head portion extending frontward from the body portion and having an outer diameter that is smaller than an outer diameter of the body portion, the body portion defining an internal bore configured to receive the drill bit, the body portion further including a retaining member configured to engage with the drill bit to inhibit removal of the drill bit from the body portion;

an anchor guide having a sleeve body defining a bore having a rear portion sized to slidably receive the body portion of the driving member and a front portion sized to slidably receive the head portion of the driving member, the front portion further including a holding member configured to releasably hold an anchor in the front portion of the bore; and a stopping member coupled to at least one of the driving member and the anchor guide to prevent complete removal of the driving member from the anchor guide, wherein when an anchor is held in the anchor guide and the drill bit is inserted into the driving member, axial movement of the drill bit is transferred to axial movement of the driving member, which causes the head portion to strike the anchor and eject the anchor from the anchor guide.

9. The anchor installation kit of claim 8, wherein the drill bit includes an annular groove and the retaining member includes a biased body that engages the annular groove in the drill bit.

10. The anchor installation kit of claim 9, wherein the biased body includes a ball and a spring clip biasing the ball generally transverse to the axis.

11. The anchor installation kit of claim 8, wherein the holding member includes a magnet.

12. The anchor installation kit of claim 8, wherein the stopping member defines an interior shoulder in the anchor guide bore that engages with a portion of wider diameter on the driving member.

13. The anchor installation kit of claim 8, wherein the stopping member includes a groove in the driving member, a ring received in the groove, and a stop surface on the anchor guide bore.

14. The anchor installation kit of claim 13, wherein the ring includes at least one of a spring clip and an O-ring.

* * * * *